United States Patent [19]

Thompson

[11] 3,987,896

[45] Oct. 26, 1976

[54] MATCH CONTAINER

[76] Inventor: Dennis R. Thompson, Apt. 1803, 8 Charles Plaza, Baltimore, Md. 21201

[22] Filed: May 20, 1975

[21] Appl. No.: 579,270

[52] U.S. Cl. ..... 206/109; 206/106

[51] Int. Cl.[2] ..... A24F 27/00

[58] Field of Search ..... 206/106, 109, 98, 100, 206/137

[56] References Cited

UNITED STATES PATENTS

| | | | |
|---|---|---|---|
| 483,165 | 9/1892 | Pusey | 206/100 |
| 814,745 | 3/1906 | Storm | 206/137 |
| 1,351,241 | 8/1920 | Graham | 206/98 |
| 2,217,854 | 10/1940 | Baldwin | 206/109 |
| 2,935,184 | 5/1960 | Olson | 206/109 |
| 3,561,590 | 2/1971 | Lopez | 206/100 |

*Primary Examiner*—William T. Dixson, Jr.
*Attorney, Agent, or Firm*—J. Wesley Everett

[57] ABSTRACT

The match container is provided with a separate match retaining element and a separate hollow match striking element in which a striking surface is located within a pocket formed within the striking element after which the two elements are permanently attached to each other. The striking element is constructed of a non-combustible material having at least one collapsible side and an opening in at least one edge of the striking element through which a match head and part of the match stick is inserted to a point where the match head will be in the area of the striking surface and will be ignited when the wall of the striking element is collapsed and the match withdrawn from the pocket.

1 Claim, 12 Drawing Figures

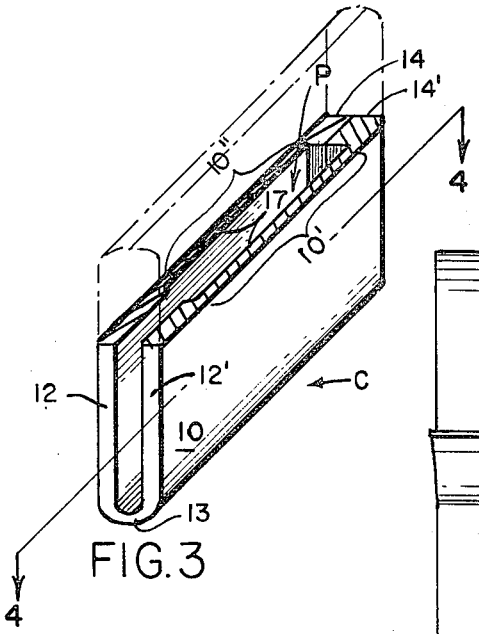
FIG. 3
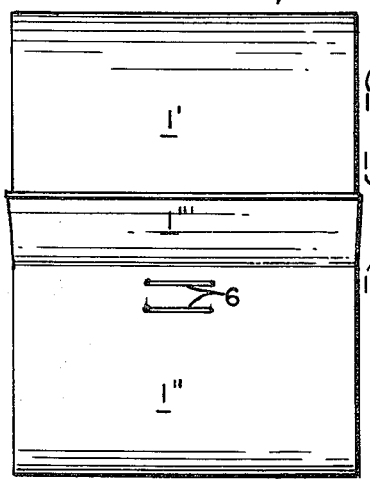
FIG. 2
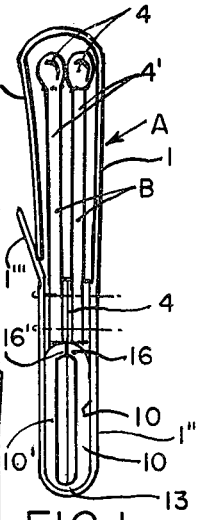
FIG. 1
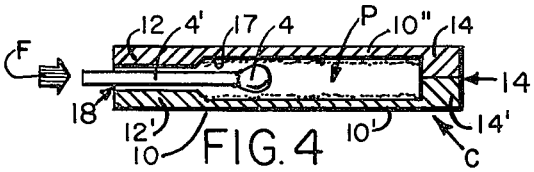
FIG. 4
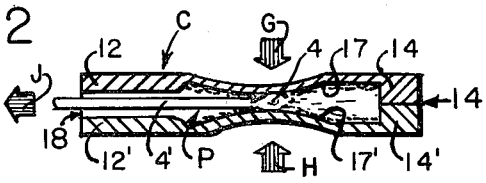
FIG. 5
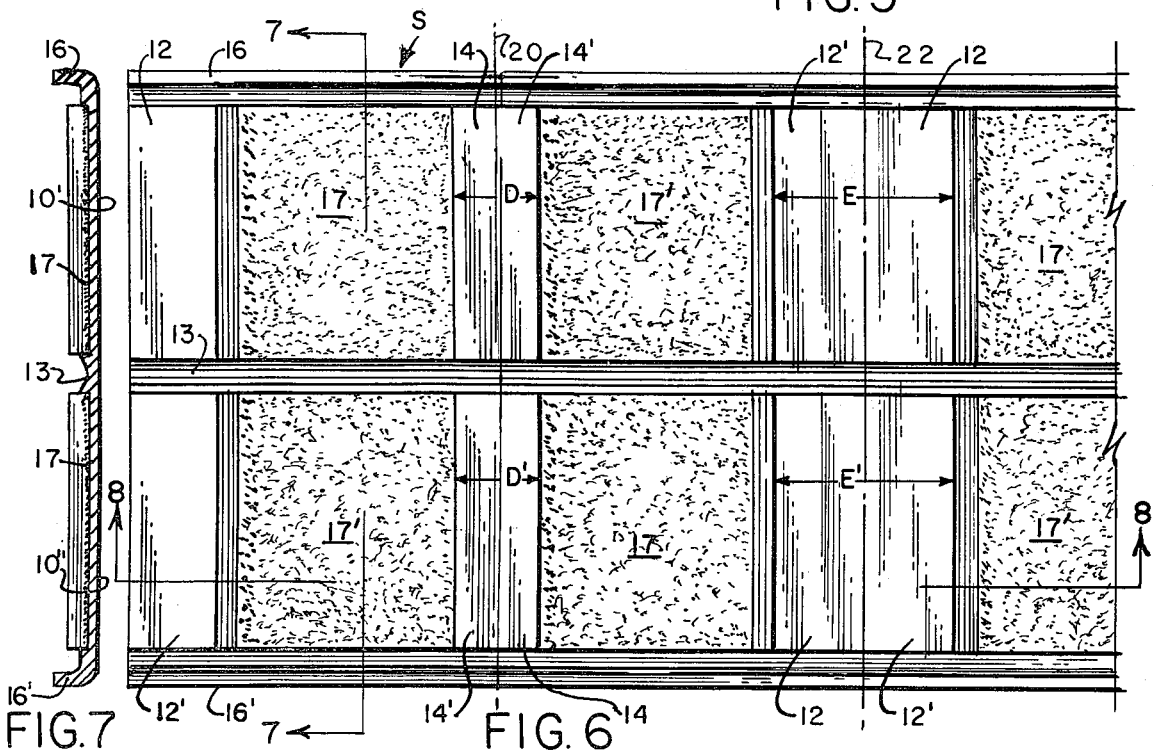
FIG. 7
FIG. 6

MATCH CONTAINER

The present invention relates to an improvement in a match container in which the container is provided with a match retaining element and a match striking element in which a match retaining element and a match striking element are formed separately and combined to form the match container.

One object of the invention is to provide a match container having exceptional safety features.

Another object of the invention is to form a striking element from non-combustible moldable material in which the ignited match head is substantially enclosed within a pocket during the igniting period.

Still another object of the invention is to provide a structure which small children will find difficult to master.

Still another object of the invention is to inhibit sparks from being raked out as the match is withdrawn by having baffles on the inner side of the opening through which the match is inserted and withdrawn.

While several objects of the invention have been pointed out, other objects will become more apparent from the following description with reference to the accompanying drawings, where like and similar reference characters designate like and similar parts throughout the several views:

FIG. 1 is an end view in elevation of a paper match container showing the location of the striking means in respect to the container.

FIG. 2 is an elevational side view thereof.

FIG. 3 is an enlarged perspective fragmentary sectional view of the striking element.

FIG. 4 is a sectional view taken on line 4—4 of FIG. 3.

FIG. 5 is also a sectional view similar to FIG. 4 taken along line 4—4 of FIG. 3, showing the sides of the striking element in collapsed position.

FIG. 6 shows a plan view of one form in which the striking means is initially formed.

FIG. 7 is a sectional view taken along line 7—7 of FIG. 6.

Figure 8:
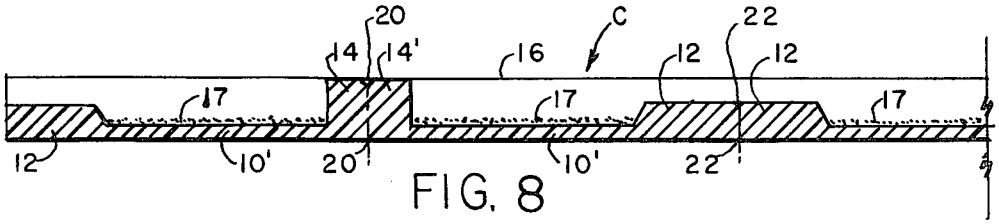
FIG. 8 is a sectional view taken along lines 8—8 of FIG. 6.

The match container A shown in FIGS. 1 and 2 comprises a match retaining element 1 for retaining a book of matches B, the base 4 of the match book being secured to the match retaining element by the staples 6. The match retaining element is provided with a removable cover 1'. The side of the retaining element 1'' being extended downwardly beyond the stapled area 4 of the match book as shown in FIGS. 1 and 2 in order to receive a separate match striking element C. The portion 1'' of the match retaining element and the portion 1''' being held in fixed position also by the staples 6. The portion 1''' is utilized to hold the cover 1' in position over the matches.

The striking elements are preferably molded from a suitable material such as a non-combustible plastic material and may be formed individually or in multiple strips. If the units are formed in multiple strips, they are separated into individual units to be later referred to. These striking elements are preferably molded in a flat or partially flat form and folded to closed position as shown in FIGS. 1, 3, 4 and 5.

FIG. 3 shows an enlarged perspective fragmentary sectional view of the form of the match striking element C to be attached to the match retaining element 1. The match striking element C is formed to provide a pocket P and is of flat rectangular shape having a smooth outer surface 10 and an opening 18 in one of its edges through which a match head 4 and a part of the match stick 4' may be inserted for igniting the match as shown in FIGS. 4 and 5. The central section 10' and 10'' of the side wall of the striking element C are thin and flexible, having striking surfaces 17 and 17' on the inner surface thereof, the longer edges of the striking element being sealed along one edge as shown at 13 and along the other edge by members 16 and 16'. The side walls 12 and 12' at each side of the opening 18 are made more rigid than the walls of the central section 10' and 10'' in order that the open end through which the match is inserted is always in an open position.

The side of the striking element opposite the open end 18 is also closed against possible emission of sparks from the lighting of the match, as shown at 14 and 14'.

The striking operation is best shown in FIGS. 4 and 5. The match is inserted through the opening 18 in the direction of the arrow F, as shown in FIG. 4. When the head of the match reaches the elastic central sections 10' and 10'', the side areas are compressed as indicated by the arrows G and H. When the match is withdrawn from the pocket P as indicated by the arrow J, the match will be ignited.

Figure 9:
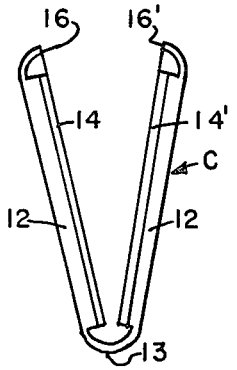
FIG. 9 is an end view of the striking means at another stage of its construction.
Figure 10:
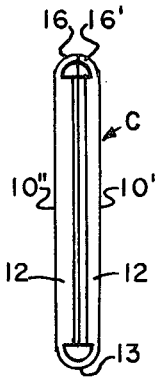
FIG. 10 is an end view of the striking means after it has been completely formed and ready to be attached to the match retaining element.
Figure 11:
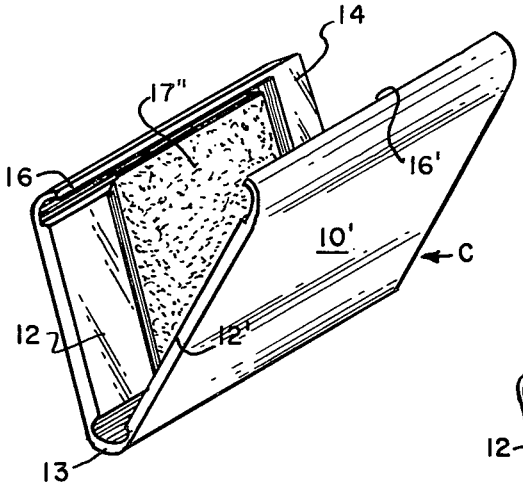
FIG. 11 is a view in perspective of the striking means at one stage of its construction showing more plainly the inner surface of the striking means.
Figure 12:
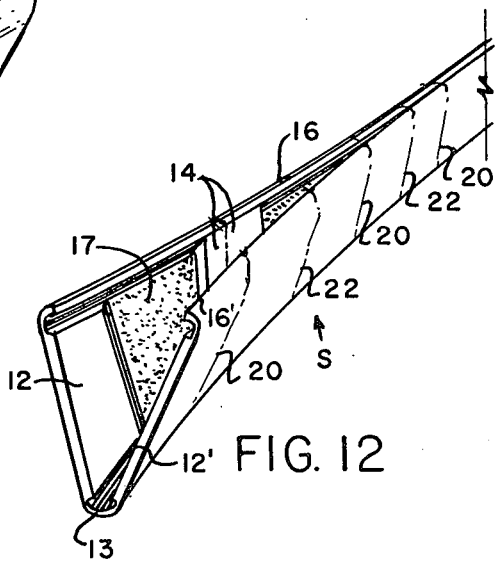
FIG. 12 is a view in perspective illustrating the manner in which the striking element is formed in multiple units.

Reference is now made to the multiple forming of the strip of the striking unit, which is shown best in FIGS. 6 to 12. The units are cut from a single molded sheet S, which has been molded in different thicknesses. The sheet is designed to be folded upon itself along a hinged area 13 to form two parallel side sections 10' and 10''. The area 10' and 10'' are molded thinner than the remaining areas and are elastic and easily compressible. The sheet may consist of a number of matching striking elements and are separatable along lines 20 and 22 to form the independent striking elements.

In addition to the thin central areas 10' and 10'' the areas 12'', 12''', 14'' and 14''' are double in width as shown at D, D', E and E'. The areas D and D' are the thickest and when the individual striking elements are separated from the sheet along lines 20 and 22 there will be formed members 14 and 14'. When the striking element is separated and folded along the hinge 13, the portions 14'' and 14''' will be in contact and maybe united if desired, by gluing or in any convenient manner to close the edge of the pocket P opposite the opening 18. The areas E and E' are not as thick as the areas D and D' but are thicker than the areas 10' and 10'' and when divided will form side sections 12 and 12', which extend along each side of the opening 18.

The forming of the individual striking units may be continued as previously described through the length of the sheet.

A match ignited within the pocket as shown and described will provide maximum safety, and will make it difficult for accidental igniting of the match particularly by children.

While the match container has been shown and described in a particular form, it is not intended as a limitation, as the scope of the invention is best defined in the appended claims.

I claim:

1. A combination match container and striking element in which the match container is in the form of a flexible cover sheet wherein the cover is folded upon itself to provide a back portion and a frontal portion, means for securing the base of a book of matches to the back portion of the sheet, the end of the sheet adjacent the base of the match book being looped outwardly from the base of the match book of such size as to receive a molded striking element, the improvement comprising:

a. a match striking element comprising a foldable molded sheet when folded is of rectangular shape having parallel side portions forming a pocket between the side portions, said match striking element being closed along its top, bottom and one end, the opposite end of the folded sheet having an elongated slot from top to bottom thereof and of such width as to allow free passage of a match head therethrough, the sidewalls of the sheet adjacent the opening being substantially rigid, the remainder of the sidewalls of the sheet being substantially thinner than the portion of the sidewall adjacent the opening to make the thin portion of the walls compressible to engage the match head when the match head is passed through the opening to the area between the thin and flexible central portion of the pocket, the inner surfaces of the thinner and flexible sidewalls being provided with a match striking substance whereby the match is ignited when the sidewalls of the thinner portion of the pocket are pressed in contact with the match head and the match head withdrawn from the area between the flexible sidewall portions.

* * * * *